United States Patent [19]

Sato

[11] 4,332,060

[45] Jun. 1, 1982

[54] SPRING CLIP FOR HOLDING SHEETS OF PAPER OR THE LIKE

[76] Inventor: Hisao Sato, 10, Toyotamaminami-3-chome, Nerima-ku, Tokyo, Japan

[21] Appl. No.: 142,714

[22] Filed: Apr. 21, 1980

[30] Foreign Application Priority Data

Apr. 28, 1979 [JP] Japan ..... 54-57827[U]

[51] Int. Cl.[3] ..... B42F 1/02; A44B 21/00

[52] U.S. Cl. ..... 24/67.9; 24/67.5; 24/259 R; 24/DIG. 9; D19/65

[58] Field of Search ..... 24/67.9, 67 R, 67.3, 24/67.5, 255 R, 259 R, DIG. 9; D19/65

[56] References Cited

U.S. PATENT DOCUMENTS

| | | | |
|---|---|---|---|
| 360,960 | 4/1887 | Hamilton | 24/67.9 |
| 487,960 | 12/1892 | McDonald, Jr. | 24/67.5 |
| 522,227 | 7/1894 | McDonald | 24/67.5 |
| 913,876 | 3/1909 | Cohen | 24/67.5 |
| 1,150,073 | 8/1915 | Spengler | 24/259 R |
| 1,590,682 | 6/1926 | Hart | 24/255 R |
| 2,385,209 | 9/1945 | Joyce | 24/259 R |
| 2,999,569 | 9/1961 | Wilson | 24/259 R |
| 3,286,381 | 11/1966 | Wooge | 24/67.5 |
| 3,648,334 | 3/1972 | Swalm | 24/259 R |
| 3,914,824 | 10/1975 | Purdy | 24/67.9 |

FOREIGN PATENT DOCUMENTS

| | | | |
|---|---|---|---|
| 690435 | 4/1940 | Fed. Rep. of Germany . | |
| 609201 | 9/1948 | United Kingdom | 24/67.5 |

*Primary Examiner*—Victor N. Sakran
*Attorney, Agent, or Firm*—Philip Rodman

[57] ABSTRACT

A spring clip having a pair of opposing flat holding members the leading ends of which are resiliently pressed against each other to clip sheets of paper or the like therebetween and opposing ear-like projections which extend widthwise from the side edges of the opposing holding member, respectively, and serve to open the leading ends of the holding members in cooperation with opening means of a special device for applicating clips. In contrast with a conventional spring clip of the same type, the disclosed clip has no levers pivoted to the leading ends of the holding members, which are used to open the leading ends of the holding members for the purpose of inserting therebetween the sheets to be clipped, and, therefore, is advantageous since the clipped sheets are not prevented by the levers from being turned up.

16 Claims, 8 Drawing Figures

SPRING CLIP FOR HOLDING SHEETS OF PAPER OR THE LIKE

BACKGROUND OF THE INVENTION

The present invention relates to a spring clip for holding sheets of paper or the like.

There have been devised and widely used spring clips of the type in which a pair of flat holding members are so constructed that leading edges or lips thereof are normally resiliently pressed against each other. In order to open the spring clip or to move the lips away from each other for holding sheets of paper or the like therebetween, the spring clip is provided at its leading edges with a pair of levers which are generally made from wire or the like. When one grips the levers between his fingers and pushes them toward each other, the spring clip is opened. After holding the sheets of paper or the like, the levers are folded forward over the outermost sheets. As a result, they extend over the sheets beyond the leading edges of the spring clip by a relatively great distance so that one often has inconvenience when turning the sheets. In addition, in the case of a relatively large spring clip, one must apply considerably greater force to open it so that some people like a child cannot open it.

SUMMARY OF THE INVENTION

The present invention was made to overcome the above and other problems encountered in the prior art spring clips of the type described.

The primary object of the present invention is to provide a spring clip for holding sheets of paper or the like which is capable of opening the leading portions or lips thereof without aid of the aforementioned lever means.

According to the present invention the spring clip comprises a pair of opposing substantially flat holding members arranged in such a way that the leading portions thereof are normally resiliently pressed against each other and at least one pair of opposing ear-like projections, each extending widthwise from at least either of side edges of each said holding member.

Since the spring clip in accordance with the present invention is not provided with the lever means for opening the spring clip, one has no inconvenience in turning the sheets of paper or the like held by the spring clip. In order to open the spring clip of the present invention, a clip application device designed specially for applying or opening the spring clip is used. This device is very simple in handling. Briefly stated, when the spring clip loaded in this device is pushed forward, the ear-like projections engage with guide means which automatically moves the projections away from each other, whereby the spring clip is opened. After inserting the sheets of paper or the like into the opened holding members, one further pushes forward the spring clip. Then the spring clip is pushed away from the guide means so that the flat holding members immediately spring back, thereby firmly holding the sheets of paper or the like between them. In addition, the clip having held the sheets of paper or the like can be easily removed by just gripping it between fingers and pulling it away from the sheets.

According to one aspect of the present invention, the spring clip is provided with an eye hook so that it may be hung.

The above and other objects, effects, features and advantages of the present invention will become more apparent from the following description of preferred embodiments thereof taken in conjunction with the accompanying drawings.

BRIEF DESCRIPTION OF THE DRAWINGS

Same reference numerals are used to designate similar parts throughout the figures.

DESCRIPTION OF THE PREFERRED EMBODIMENTS

Figure 1:
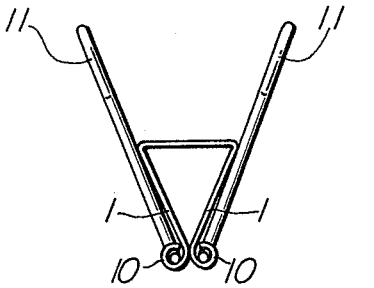
FIG. 1 PRIOR ART
FIG. 1 is a side view of a prior art spring clip.

Referring first to FIG. 1, there is shown a prior art spring clip. The spring clip has a pair of flat holding portions 1 which are made from an integral resilient strip and formed to be converged toward the leading edges thereof so as to provide lips resiliently pressed against each other for clipping sheets of paper or the like and a pair of levers 11 which are generally made from wire and pivotally attached to opening 10 formed by bending the leading portions of the holding portions. Before opening the spring clip, the levers 11 are turned rearwardly as shown in FIG. 1. When one grips the rear portions of the levers 11 between his fingers and pushes them toward each other, the lips formed at the leading edges of the holding portions 1 are opened for being ready to clip sheets of paper or the like therebetween. After having clipped the sheets, the levers 11 are turned forwardly to extend over the outermost sheets. The levers 11 extending over the sheets have a tendency to prevent sheets from being turned up.

Figure 2:
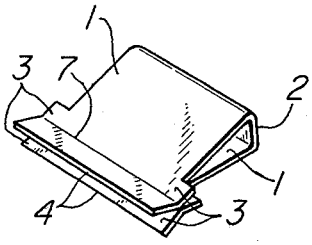
FIGS. 2 through 5 are perspective views, respectively, of first through fourth embodiments of the present invention.

Referring to FIG. 2, there is shown a spring clip of a first embodiment of the present invention. In like manner as the prior art spring clip as shown in FIG. 1, the spring clip of the first embodiment is made from an integral blank strip of a resilient material such as spring steel or plastics and formed by bending the strip with a pair of flat holding portions 1 and a rear wall portion 2 bridging between the rear ends of the flat holding portions 1, the holding portions 1 being converged from the rear ends connected to the rear end portion 2 toward the front ends to provide at the front ends lips resiliently pressed against each other. In accordance with the present invention the pair of holding portions 1 are further provided with ear-like projections 3 extending widthwise from opposite side edges thereof which are adapted to engage with opening means B of a spring clip application device to open the lips as will be described in detail hereinafter with reference to FIGS. 6 and 7. In the first embodiment as shown in FIG. 2, projections 3 are formed contiguously to the side edges of the lip portions and the projections 3 as well as the lip portions are slightly bent outwardly from a widthwise line 7 in parallel with the leading edges 4 of the holding portions 1 so as to provide a space between the opposing front ends of the projections 3 for facilitating the opening means B to be inserted between the opposing projections 3 to open the lips as will be seen later. Alternatively only the projections 3 may be bent outwardly from the line 7 while keeping the opposing leading edges 4 of the lip portions between the projections 3 in contact with each other.

Figure 3:
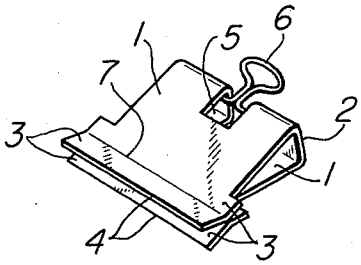

In FIG. 3 is shown a second embodiment of the present invention which is substantially similar in construction to the first embodiment described above with reference to FIG. 2 except that it is provided with a notch 5 formed through the rear wall portion 2 intermediate the side edges thereof. An eye hook 6 is engaged with this notch 5. That is, the two legs of the eye hook 6 are fitted into the notch 5 and folded so as to engage or clinch with the bridge portion 3, whereby the eye hook 6 can be prevented from being pulled out of the notch 5. Obviously, the eye hook 6 is provided to hang the spring clip.

In both the first and second embodiments, the leading edge portions are bent outwardly as described above so that they not only facilitate the engagement with the opening means B but also serve to reinforce the lip portions.

Figure 4:
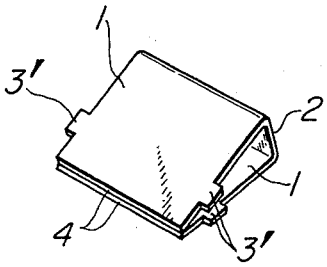

In FIG. 4 is shown a third embodiment of a spring clip in accordance with the present invention. As in the first or second embodiment, the spring clip is made of a resilient blank strip and formed by bending the strip with a pair of opposing flat holding portions 1 and a rear end wall portion 2 bridging between the rear ends of the holding portions 1, the holding portions 1 being converged from the rear ends toward the front ends thereof to provide at the front ends opposing lips resiliently passed against each other. In contrast with the first and second embodiments, the third embodiment has leading edges 4 kept in contact with each other without bending the front end portions of the holding portions 1 outwardly. Instead the spring clip is provided with ear-like projections 3' extending widthwise from the side edges of the holding portions 1 at positions slightly displaced rearwardly from the leading edges 4 of the holding portions 1. The position will be such one that the opposing projections 3' are spaced from each other by such an extent that the opening means B of the clip application device can easily be inserted between the projections 3' and open the lips or leading edges 4 sufficient to be ready to clip the sheets of a suitable thickness.

Figure 5:
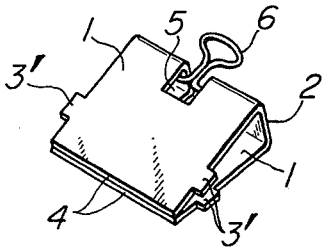

In FIG. 5 is shown a fourth embodiment of the present invention which is substantially similar in construction to the third embodiment just described above except that as is the second embodiment, it is provided with the eye hook 6.

Figure 6:
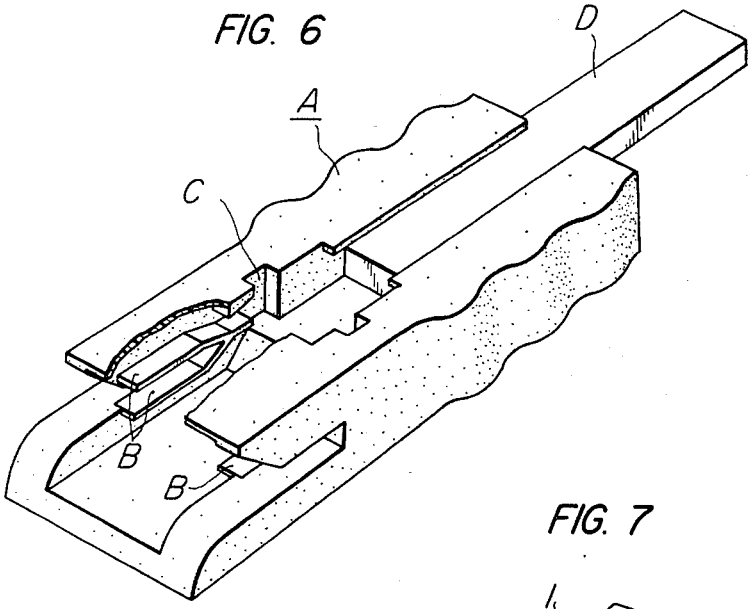
FIG. 6 is a perspective view of a device for opening the spring clip in accordance with the present invention.
Figure 7:
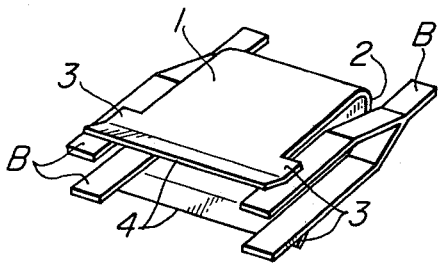
FIG. 7 is a view used for the explanation of the steps for opening the spring clip by the device shown in FIG. 6.

Next the steps for holding sheets of paper or the like with the spring clip in accordance with the present invention will be described with reference to FIGS. 6, 7 and 8. In contrast with the prior art spring clip which, as shown in FIG. 1, is provided with levers 11 for opening the spring clip, the spring clip in accordance with the present invention has no lever. In addition, the resilient holding force provided by the spring clip of the present invention is considerably strong so that it is extremely difficult though not impossible for ordinary person to open it with fingers. Therefore the spring clip application device A as shown in FIGS. 6 and 7 is used for opening the spring clip. The spring clip is loaded in a guide slot C. Tuning fork-like opening guides B are disposed along the side walls of the guide slot C. Each opening guide B consists of an engaging portion which engages with the ear projections 3 or 3' of the spring clip, a pair of slanting guideway portions extended from the engaging portion and diverging at a predetermined included angle and a pair of parallel guideway portions extended forwardly of the slanting guideway portions in parallel with each other and spaced apart from each other by a predetermined distance.

When the clip is pushed by a pusher D, the ear projections 3 or 3' of the spring clip are brought to engage with the engaging portions of the opening guides B. As the spring clip is further pushed forward, the projections 3 or 3' ride over the slanting guideway portions so that as the spring clip is pushed forward, the opposing projections 3 or 3' are gradually moved away from each other and consequently the lips of the flat holding portions 1 are gradually opened. When the projections 3 or 3' ride over the parallel guideway portions, the projections 3 or 3' and hence the lips of the flat holding portions 1 are completely opened or spaced apart from each other by a predetermined distance. The sheets of paper or the like are then inserted between the opened lips of the flat portions 1 and then the pusher is further pressed forward. Then the projections 3 or 3' are pushed out of the leading edges of the parallel guide portions of the guides B so that the flat portions 1 immediately spring back to close the lips, thus firmly holding the sheets of paper or the like between them as shown in FIG. 8.

Figure 8:
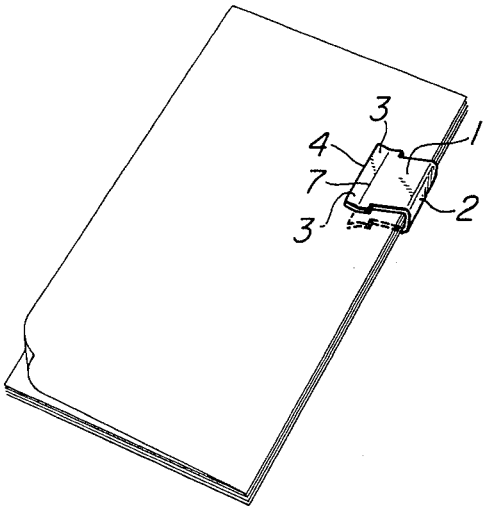
FIG. 8 shows some sheets of paper clipped by the clip of the present invention.

To remove the spring clip, one grips it with fingers and pulls to the right in FIG. 8. Then the spring clip may be readily removed from the sheets of paper or the like.

As described above, the spring clip of the present invention comprises only the minimum parts which are essential for holding the sheets of paper or the like. As a result, the spring clip in accordance with the present invention is very simple in construction and compact in size. In addition, the spring clip of the present invention is not provided with the levers 11 as shown in FIG. 1 so that one may easily turn over a desired page or sheet. Moreover, according to the present invention in order to hold sheets of paper or the like with the spring clip, the application device A of the type described with particular reference to FIGS. 6 and 7 is used. The force required for pushing the pusher D is considerably smaller than the force required for opening the prior art spring clip by gripping the levers 11. As a result, even the children may readily use the spring clips of the present invention.

So far the present invention has been described in conjunction with the preferred embodiments shown in the accompanying drawings, but it is to be understood that the present invention is not limited thereto and that various modifications may be effected without leaving the true spirit of the present invention. For instance, the flat holding portions 1 have been described as being provided with two pairs of opposing projections 3 or 3' at the both side edges thereof, respectively, but only one pair of them may be provided on either one of the both side edges. The spring clip has been described as being made from an integral, resilient blank sheet, but it is to be understood that the flat holding portions 1 may be fabricated separately and connected to each other along their rear edges by a suitable spring means in such a way that the front edges are resilient pressed against each other.

What is claimed is:

1. A spring clip for holding sheets of paper or the like, comprising a pair of cooperating confronting holding members, each said holding member having opposite side edges, a free continuous leading end portion, including a leading edge, a rear portion opposite said leading end portion and joining means for resiliently joining said holding members together at their respective rear portions such that said leading end portions are normally resiliently biased against each other with a predetermined clamping force, the joining means having no means for diverging said holding members, at least one of the side edges of one of the holding members corresponding to one of the side edges of the other said holding member, an ear-like projection for diverging said holding members extending a predetermined amount from each of said corresponding side edges and having portions spaced from each other to permit insertion of a spreader member between said ear-like projections in removable relationship for exertion of a separating force by said spreader member against each of said ear-like projections to cause divergence of said holding members and separation of said leading end portions whereby said sheets of paper or the like can be disposed between said holding members to be gripped by said leading end portions when said ear-like projections are disassociated from said spreader member, no portion of said ear-like projections being in contact with each other at the leading edge of each said holding member, and wherein said ear-like projections are stepped away from said side edges.

2. A spring clip as claimed in claim 1 wherein the ear-like projections on at least one holding member are spaced from the leading edge and disposed between the leading end portion of said one holding member and the joining means.

3. A spring clip as claimed in claim 2 where the ear-like projections on the other holding member are spaced from the leading edge and disposed between the leading end portion of the other holding member and the joining means.

4. A spring clip as claimed in claim 1 wherein said clip is formed from a resilient sheet bent to form a bridge portion between said pair of confronting holding members, said joining means being defined at the bridge portion of said sheet.

5. A spring clip as claimed in claim 4 including a notch formed in said bridge portion and a suspension member disposed in said notch to permit hanging or suspension of said clip.

6. A spring clip as claimed in claim 1 wherein the other side edges of each said holding member correspond, and respectively include ear-like projections extending from said other side edges said predetermined amount.

7. A spring clip as claimed in claim 1 wherein the ear-like projections on at least one holding member are continuous with the leading edge of said one holding member.

8. A spring clip as claimed in claim 7 wherein the ear-like projections on the other holding member are continuous with the leading edge of the other holding member.

9. A spring clip as claimed in claim 8 wherein said leading end portions and the ear-like projections thereon include a portion bent away from its confronting holding member.

10. A spring clip as claimed in claim 8 in combination with an applicator device for dispensing said clip onto said sheets of paper or the like to grip said sheets, said applicator device including a channel of predetermined width for receiving at least one said clip, a driver member slidable in said channel and engageable with the bridge portion of said clip to move said clip in a first direction, a pair of said spreader members disposed on opposite sides of said channel at a predetermined spacing from each other and arranged to diverge in said first direction such that said clip, when disposed in said channel with said leading end portions facing said spreader members, engages said spreader members in surface to surface contact with said ear-like projections when said driver member is moved against the bridge portion of said clip in said first direction to cause divergence of said leading end portions, to permit said sheets of paper or the like to be disposed between said diverged leading end portions and whereby further movement of said driver member against said clip disassociates said clip from said spreader members to permit said leading end portions to grip said sheets of paper.

11. A spring clip for holding sheets of paper or the like, comprising a pair of cooperating confronting holding members, each said holding member having opposite side edges, a free continuous leading end portion including a leading edge, a rear portion opposite said leading end portion and joining means for resiliently joining said holding members together at their respective rear portions such that said leading end portions are normally resiliently biased against each other with a predetermined clamping force, the joining means having no means for diverging said holding members, at least one of the side edges of one of the holding members corresponding to one of the side edges of the other said holding member, an ear-like projection for diverging said holding members extending a predetermined amount from each of said corresponding side edges and having portions spaced from each other to permit insertion of a spreader member between said ear-like projections in removable relationship for exertion of a separating force by said spreader member against each of said ear-like projections to cause divergence of said holding members and separation of said leading end portions whereby said sheets of paper or the like can be disposed between said holding members to be gripped by said leading end portions when said ear-like projections are disassociated from said spreader member, no portion of said ear-like projections being in contact with each other at the leading edges of each said holding member, and wherein the ear-like projections on at least one holding member are spaced from the leading edge and disposed between the leading end portion of said one holding member and the joining means.

12. A spring clip as claimed in claim 11 wherein the other side edges of each said holding member correspond, and respectively include ear-like projections extending from said other side edges said predetermined amount.

13. A spring clip as claimed in claim 12 wherein said ear-like projections are stepped away from said side edges.

14. A spring clip as claimed in claim 11 wherein the ear-like projections on the other holding member are spaced from the leading edge and disposed between the leading end portion ofthe other holding member and the joining means.

15. A spring clip as claimed in claim 14 wherein the ear-like projections on the respective said holding members are disposed closer to the leading end portions thereof than to said joining means.

16. A spring clip as claimed in claim 14 in combination with an applicator device for dispensing said clip onto said sheets of paper or the like to grip said sheets, said applicator device including a channel of predetermined width for receiving at least one said clip, a driver member slidable in said channel and engageable with the bridge portion of said clip to move said clip in a first direction, a pair of said spreader members disposed on opposite sides of said channel at a predetermined spacing from each other and arranged to diverge in said first direction such that said clip, when disposed in said channel with said leading end portions facing said spreader members, engages said spreader members in surface to surface contact with said ear-like projections when said driver member is moved against the bridge portion of said clip in said first direction to cause divergence of said leading end portions, to permit said sheets of paper or the like to be disposed between said diverged leading end portions and whereby further movement of said driver member against said clip disassociates said clip from said spreader members to permit said leading end portions to grip said sheets of paper.

* * * * *